United States Patent [19]

Szabo

[11] 4,346,888

[45] Aug. 31, 1982

[54] WEIGHT LIFTING EXERCISING APPARATUS HAVING A MOVABLE CARRIAGE

[76] Inventor: William Szabo, 10126 Langmoir Ave., Sunland, Calif. 91040

[21] Appl. No.: 166,077

[22] Filed: Jul. 7, 1980

[51] Int. Cl.³ ..... A63B 21/06

[52] U.S. Cl. ..... 272/118; 272/DIG. 4

[58] Field of Search ..... 272/118, 117, 93, 143, 272/DIG. 4, 134

[56] References Cited

U.S. PATENT DOCUMENTS

| | | | |
|---|---|---|---|
| 3,635,472 | 1/1972 | Marcyan | 272/118 |
| 3,746,338 | 7/1973 | Proctor | 272/118 |
| 4,188,029 | 2/1980 | Brower et al. | 272/118 X |
| 4,286,782 | 9/1981 | Fuhrhop | 272/117 |

FOREIGN PATENT DOCUMENTS

| | | | |
|---|---|---|---|
| 1444065 | 5/1966 | France | 272/118 |

*Primary Examiner*—Richard C. Pinkham
*Assistant Examiner*—William R. Browne
*Attorney, Agent, or Firm*—Robert J. Schaap

[57] ABSTRACT

A weight lifting body exercising apparatus comprised of a base member and one or more beams forming an upstanding frame. A vertically shiftable movement against one or more weights which may be selectively introduced. The user of the apparatus effectively lifts the weight or weights by pulling on a cable connected to the weight or weights. In some cases, the user effectively lifts the weights by pulling on the cable and moving the carriage. A first pulley is mounted on the frame above the carriage and at a height generally above the height of the user. A second pulley is mounted at the base and is located forwardly of the first pulley. A third pulley is mounted on the frame at a height generally above the height of the user and located immediately vertically above the user. In one preferred embodiment of the invention, a fourth pulley is located on the carriage. The cable may be secured to the carriage or trained around the fourth pulley on the carriage. A handle mechanism, and preferably an adjustable handle mechanism, is associated with the carriage and engagable by a user to apply a force and thereby attempt to shift the carriage against the one or more weights.

32 Claims, 9 Drawing Figures

WEIGHT LIFTING EXERCISING APPARATUS HAVING A MOVABLE CARRIAGE

BACKGROUND OF THE INVENTION

1. Field of the Invention

This invention relates in general to certain new and useful improvements in weight lifting exercising apparatus, and more particular, to weight lifting apparatus with a frame and a plurality of pulleys associated therewith so that a cable attached to one or more weights may be selectively trained about the pulleys in a number of desired orientations to thereby enable performance of a large number of exercises.

2. Brief Description of the Prior Art

In recent years, with increased emphasis on body health, there has been an introduction of a large number of weight lifting exercising apparatus. In many cases, these weight lifting exercising apparatus have become quite sophisticated. However, generally in most constructions, the weight lifting exercising apparatus is comprised of an upstanding frame, one or more weights which may be selectively introduced and a cable connected to the weights and turned around one or more pulleys. The user of the apparatus engages the cable or some member connected to the cable e.g. a handle and pulls on the cable to attempt to lift the selectively introduced weights.

While many of these apparatus have been effective in enabling one to perform body exercises by lifting weights in certain different body positions, the exercising apparatus are not highly effective in permitting a cable to be trained in a number of differing configurations to thereby enable different exercises to be performed. Moreover, each of the commercially available exercising apparatus are constructed so that they are relatively expensive and thus, not easily affordable for home use. The same holds true in that the commercially available exercising apparatus which are available to commercial institutions are also constructed in a manner where they are not sized and conveniently operated in home use.

U.S. Pat. No. RE 28,066 to Marcyan discloses a single station body exercising apparatus which is comprised of a plurality of pulleys and a means for introducing a desired amount of weight. Moreover, a cable is trained around the pulleys and a handle mechanism for the user to engage. U.S. Pat. No. 3,438,627 to La Lanne also discloses a weight lifting apparatus in which a cable is trained around a plurality of pulleys and connected to one or more weights. The other end of the cable is provided with a handle for the user to engage and to apply force in order to lift the weights. U.S. Pat. No. 3,912,263 to Yatso and U.S. Pat. No. 3,971,555 to Mahnke disclose similar forms of body exercising apparatus. The same holds true with the body exercising apparatus taught in British Pat. No. 1,438,466 and French Pat. No. 1,444,865. While some of these apparatus enable different starting positions, they are not effectively designed so that a cable may be trained in a variety of configurations to enable a large number of body exercises to be performed.

This is not a significant problem in commercial institutions, such as gymnasiums and the like, where a number of people will simultaneously use different exercising apparatus to perform various different weight lifting exercises. However, for home use, it is impractical to have a plurality of different exercising apparatus.

Another one of the problems with the commercially available exercising apparatus is the fact that most of the apparatus are constructed from structural metals, such as steel and the like. As a result, these apparatus are usually of a welded construction and not readily easily transportable. They are quite heavy and bulky and therefore costly to ship. Moreover, by virtue of construction they are not readily adaptable for easy assembly or disassembly.

OBJECTS OF THE INVENTION

It is, therefore, a primary object of the present invention to provide a weight lifting body exercising apparatus comprised of a frame with a plurality of pulleys associated with the frame in desired positions so that a cable may be trained around these pulleys in a number of desired configurations to enable a large number of body exercises to be performed through the lifting of weights connected to the cable.

It is another object of the present invention to provide an apparatus of the type stated in which a carriage is associated with the frame and is vertically shiftable against one or more weights when a force is imposed thereon by a user and which carriage also is provided with a pulley so that a cable may be selectively trained thereabout.

It is a further object of the present invention to provide an apparatus of the type stated which is highly effective in its operation and which can be constructed at a relatively low cost.

It is an additional object of the present invention to provide an apparatus of the type stated which is constructed so that it can occupy a very small amount of space and is thereby suitable for home use environments and which can also be constructed for institutional use.

It is still another object of the present invention to provide a weight lifting body exercising apparatus of the type stated which may be constructed in a single station embodiment or multi-station embodiments.

It is another salient object of the present invention to provide a weight lifting body exercising apparatus of the type stated and which is constructed so that it can be easily assembled. and disassembled with a minimum amount of manual labor.

With the above and other objects in view, my invention resides in the novel features of form, construction, arrangement, and combination of parts presently described and pointed out in the claims.

BRIEF SUMMARY OF THE DISCLOSURE

The present invention relates to a weight lifting body exercising apparatus which is comprised of a base means and an upstanding frame extending upwardly from the base means. A vertically shiftable carriage is associated with the frame and the base means and is capable of vertical shiftable movement against one or more weights which may be selectively introduced with respect to the apparatus. A handle mechanism is mounted on the vertically shiftable carriage and is movable therewith. The handle means is engagable by a user to apply force thereto and thereby attempt to shift the carriage against the one or more weights.

The apparatus comprises a first pulley which is operatively mounted on the frame generally above and behind the carriage and at a height normally greater than the height of the user of the apparatus. In addition, the apparatus includes a second pulley operatively mounted on the base means at a height normally less than the user and which is located forwardly of the first pulley. In this case, the base means may adopt the form of a base platform and which is located in close proximity to and supported by the floor or other supporting surface.

The apparatus also employs a third pulley which is operatively mounted on the frame at a height normally above the height of a user. In addition, the third pulley is located forwardly of the second pulley and at a position so that it would be almost immediately vertically above the user of the apparatus. The apparatus also employs a cable means which may be operatively engagable with the carriage and with one or more weights. The cable means is capable of being selectively trained about any two or more of the pulleys in a number of desired configurations and the configurations are selected to perform certain weight lifting exercises. Thus, when the user of the apparatus engages the handle he will attempt to lift against the downward force of the weights. Depending upon the configuration of the cable, the user may pull on the cable in a vertical direction or a horizontal direction or any direction therebetween.

In one embodiment of the invention, the first, second and third pulleys are preferably aligned within the same vertical plane and in another embodiment of the invention, a fourth pulley is operatively mounted on the carriage and is adapted to have the cable means trained therearound in order to provide additional cable configurations. Further, the fourth pulley lies in the same vertical plane as the first, second and third pulleys. In one preferred aspect of the invention, the fourth aligned pulley is removably attached to the carriage.

In another embodiment of the invention, the frame means comprises a plurality of spaced apart upright beams which are secured to the base means and to a generally horizontally located top structure, the latter being secured to the upper portions of the upright beams. Further, and in one embodiment of the invention, the handle means may be adjustably positioned on the carriage in order to permit various exercises to be performed and also to conform to the overall size of the user.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
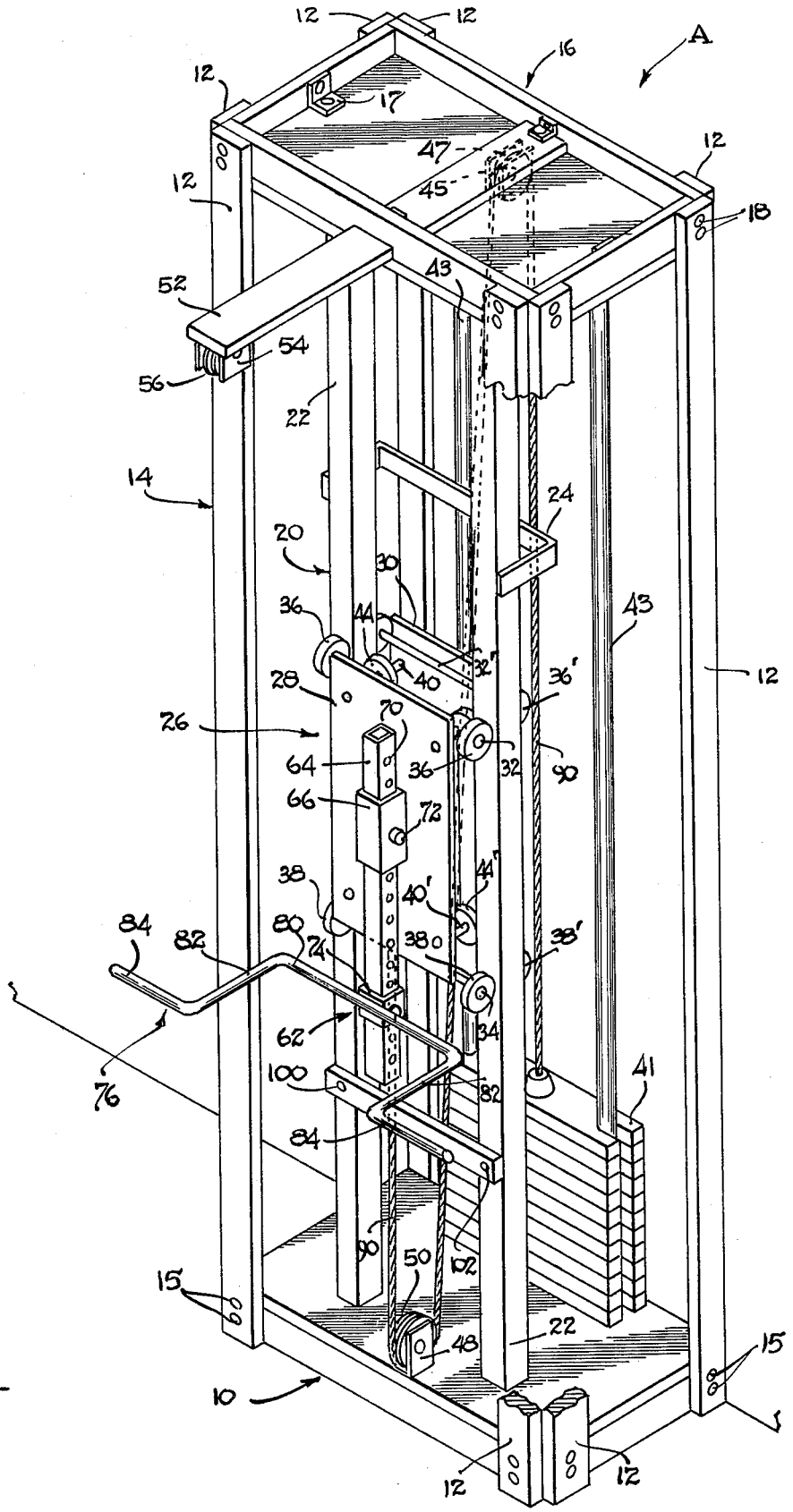
Figure 2:
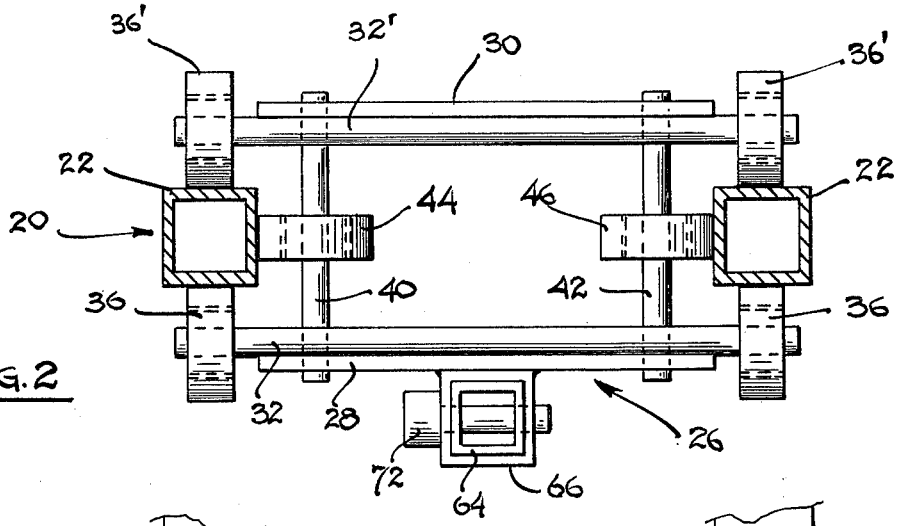
Figure 3:
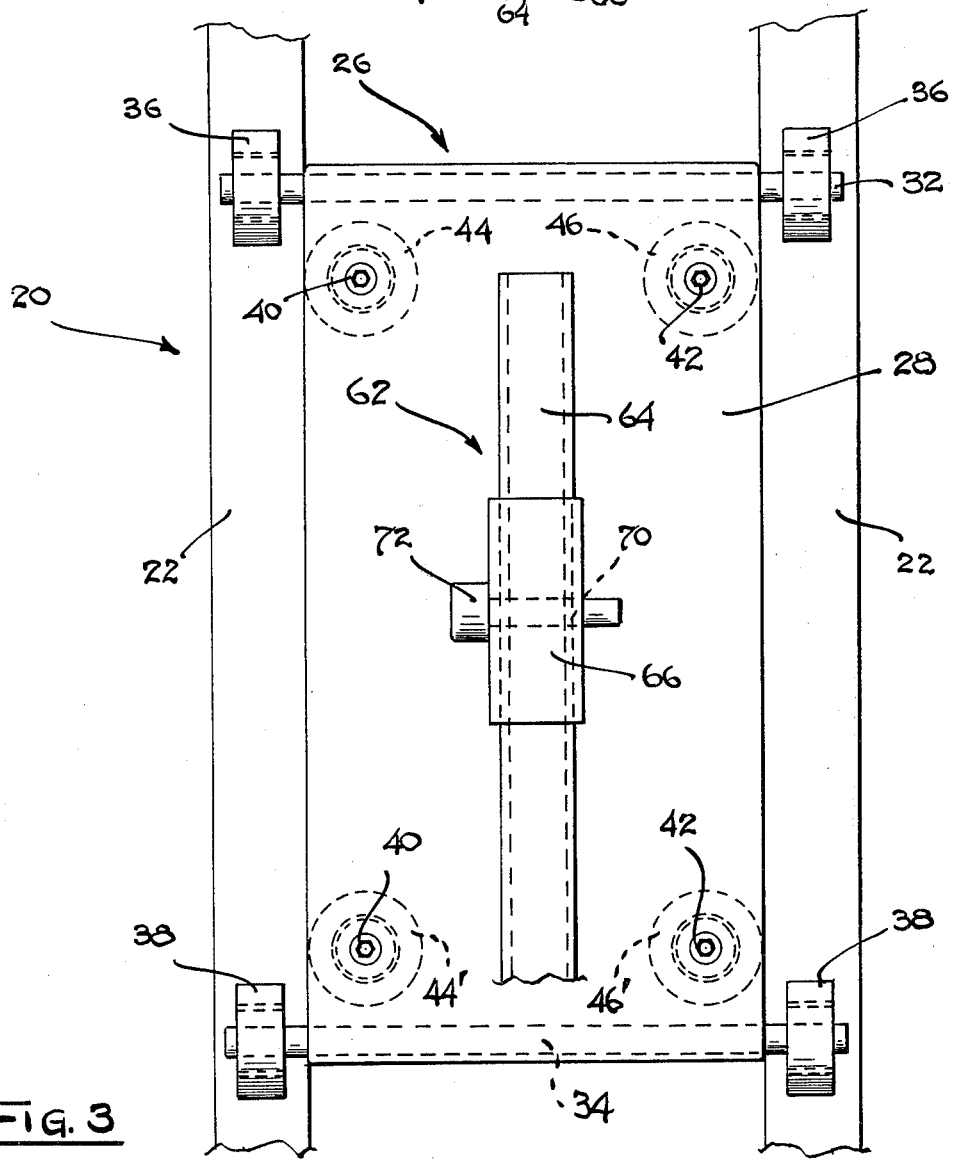
Figures 4, 4A:
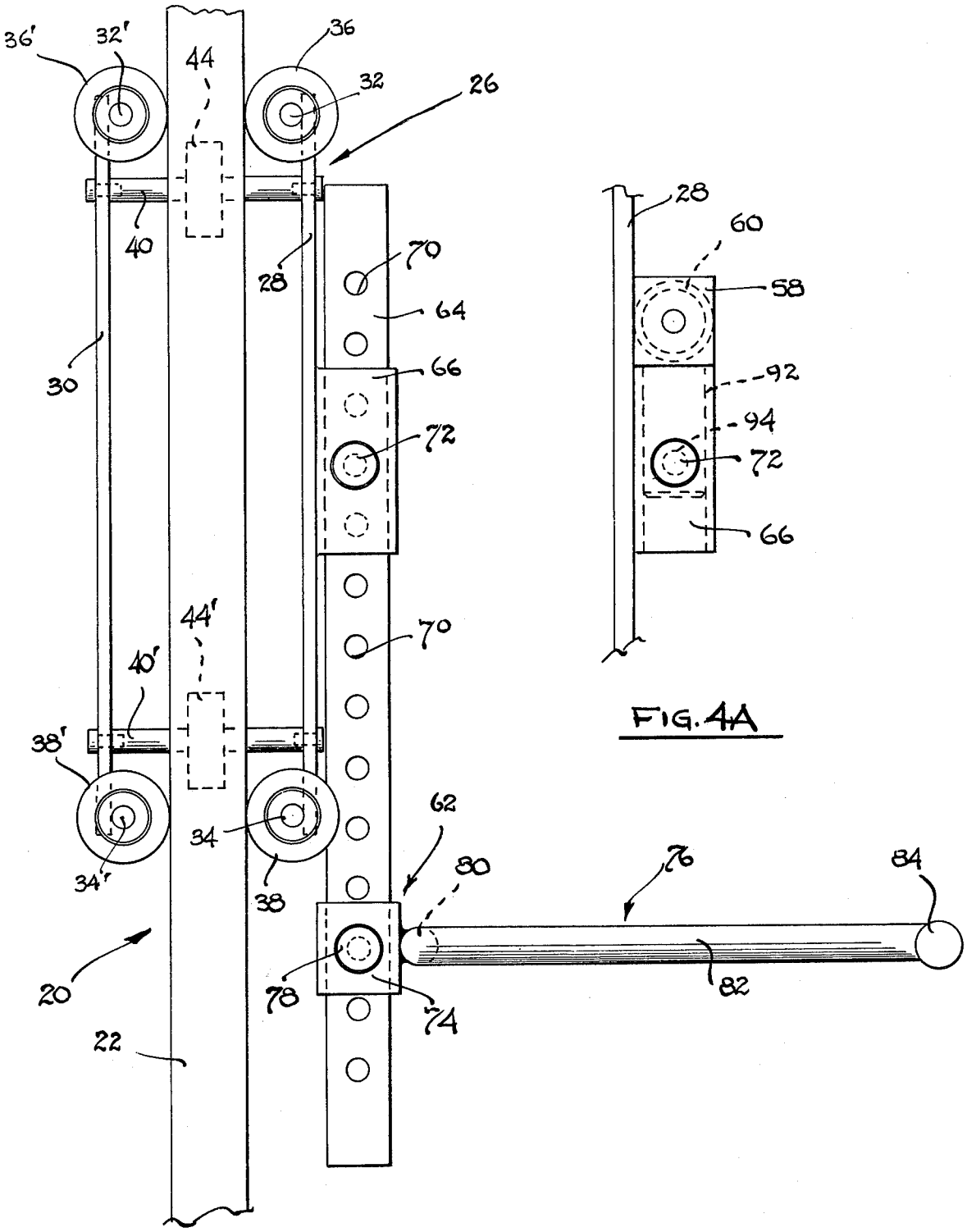

Having thus described the invention in general terms, reference will now be made to the accompanying drawings in which:

FIG. 1 is a perspective view of a body exercising apparatus constructed and in accordance with and embodying the present invention;

FIG. 2 is a top plan view, of a carriage mechanism and the associated frame when the carriage is adjusted for vertical shiftable movement in accordance with the present invention;

FIG. 3 is a fragmentary front elevational view of the construction of the carriage mechanism and the frame forming part of the apparatus of the invention;

FIG. 4 is a fragmentary side elevational view of the carriage mechanism and associated frame forming part of the apparatus of the present invention;

FIG. 4A is a fragmentary side elevational view, partially in dotted lines, and showing a removal pulley block and pulley on the carriage forming part of the apparatus; and FIGS. 5 to 8 are schematic views showing various configurations in which a cable can be trained about pulleys on the apparatus of the invention in order to permit performance of various weight lifting exercises.

DETAILED DESCRIPTION OF A PREFERRED EMBODIMENT

Referring now in more detail and by reference characters to the drawings which illustrate a practical embodiment of the present invention, A designates body exercising weight lifting apparatus comprised of a base means 10, preferably in the form of a rectangularly shaped box-like structure. In the embodiment of the invention as illustrated, the base means 10 or so-called "base housing" may rest upon or be rigidly secured to a floor or other generally horizontally disposed supporting surface. Moreover, it should be understood that the present invention illustrates the use of a single station weight lifting exerciser apparatus. However, the apparatus is constructed such that a plural station weight lifting exercising apparatus, for example, an exercising apparatus having a rectangular shape and four rectangularly located user stations could be employed.

The weight lifting exerciser apparatus A also comprises a plurality of upstanding beams 12 which form a generally upright frame 14. The beams 12 may be secured to the base housing 10 by means of a plurality of bolts 15 or similar mechanical fasteners. The beams may now be secured to a rectangularly shaped horizontally disposed frame section 16 located above the base housing 10 by means of a plurality of bolts 18 or similar mechanical fasteners. In this respect, it can be observed that the horizontally disposed frame section 16 is located at a height above the base structure 10 which is greater than the normal height of the user as hereinafter described in more detail.

A carriage supporting structure 20 also extends between the upper frame section 16 and the base structure 10 and is comprised of one or more upstanding posts, such as the pair of posts 22, illustrated in FIG. 1 of the drawings. These posts 22 are often referred to as "guide bars" inasmuch as they serve to guide the movement of a carriage as hereinafter described. The posts 22 and 22 may also be secured to the base structure 10 and the upper frame section 16 by conventional mechanical fasteners. The posts 22 are further reinforced over their length by means of one or more brackets 24, such as U-shaped brackets which extend therebetween.

Mounted on the carriage supporting structure 20 for vertical shiftable movement therealong is a carriage 26 which is also more fully illustrated in FIGS. 2–4 of the drawings. In this case, it can be observed that the carriage 26 is comprised of a pair of generally parallel and spaced apart plates 28 and 30.

Mounted on the outermost plate 28 near the upper and lower margins thereof are a pair longitudinally extending roller supporting shafts 32 and 34 and similarly mounted on the interiorly presented surface of the rearward plate 30 are longitudinally extending upper and lower roller supporting shafts 32' and 34', much in the manner as illustrated in FIGS. 3 and 4 of the drawings. In addition, and mounted on the upper and lower supporting shafts 32 and 34 are rollers 36 and 38 which bear against the respective posts 22. In like manner, the roller shafts 32' and 34' also carry rollers 36' and 38' which bear against the opposite sides of the upright posts 22. In essence, the pairs of rollers 36 and 38 bear against the forwardly presented surfaces of the posts 22 and the pairs of rollers 36' and 38' bear against the rearwardly presented surface of each of the upright posts 22.

Also carried by and extending between each of the plates 28 and 30 are transversely extending upper roller supporting shafts 40 and 42. Each of these shafts carry rollers 44 and 46, respectively, which bear against opposed sides of each of the two vertical posts 22. Moreover, it can be observed by reference to FIG. 3 that there are provided lower roller supporting shafts 40' and 42'. The lower shafts carry the similar rollers 44' and 46' respectively.

Figure 7:
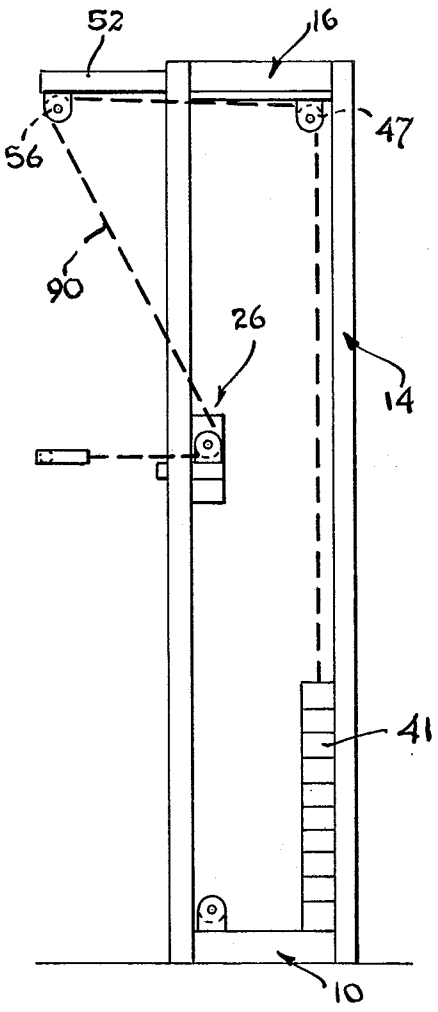

By further reference to FIGS. 1 and 7, it can be observed that bolts 37 extend into the opposite ends of each of the transversely extending roller supporting shafts 40 and 40. In this way the heads of the bolts 37 which bear against the exterior surfaces of the plates 28 and 30 enable the bolts to hold the carriage in the assembled construction. Further, it is easy to disassemble the carriage by merely removing the bolts 37. Thus, the carriage is easily assembled and disassembled at an on-site location, further, facilitating ease and low cost of shipping.

In accordance with the above outlined construction, it can be observed that the carriage 26 is retentively held on the two upright posts 22 forming part of the frame 20 such that it is capable of vertical shiftable movement and nevertheless is always retained on the posts 22 for vertical shiftable movement by the roller assemblies as heretofore described in connection with FIGS. 2 to 4 of the drawings.

It can be observed that the exercising apparatus of the present invention can be easily assembled at an on-site location inasmuch as it is comprised of only a few major subassemblies, such as a base member, an upper frame section 16 and the posts which are secured to the upper frame section and the base member by conventional fasteners. Moreover, it can also be observed that the carriage itself is easily assembled and positioned on the carriage supporting structure 20. In this way, the exercising apparatus of the present invention can be easily assembled and disassembled for transport and for temporary use conditions.

The major structural members of the exercising apparatus of the present invention may be formed of a wide variety of structural materials, as for example, wood, although various metals such as aluminum, steel and the like may be employed. In addition to the foregoing, various reinforced plastic composite materials, such as fiberglass-epoxy resin composites and the like may also be employed.

Further, and in one embodiment of the invention, for purposes of assembly, the beams of the various components forming part of the base structure 10 as well as the upper frame section 16 may be formed of wooden planks which are secured together by the fasteners 15 as aforesaid. However, the fasteners which are used in conjunction with brackets 17 to secure same to the portion of the upper frame section may be the bolts 15 as aforesaid, or they may be wood screws, or the like, much in the manner as illustrated in FIG. 1 of the drawings. It should be understood that other means for securing the members forming part of the apparatus of the present invention may also be employed. For example, the various upright beams when formed of metal, could be secured to the base structure and the upper frame section by welding or other conventional techniques known in the art.

By reference to FIG. 1, it can be observed that one or more weights, such as plate-type weights 41, may be disposed on the base housing 10. The plate-type weights 41 are shiftable along a pair of longitudinally spaced apart vertically extending guide posts 43, also in the manner as illustrated in FIG. 1. These guide posts 43, extend between the upper frame section and the lower base housing 10. Thus, one or more weights may be selectively introduced so that the user of the apparatus attempts to lift the weights. In some cases, the weights are operatively connected to the carriage such that the carriage 26 can be moved against the weight of these one or more plate-type weights, as hereinafter described in more detail. It should be understood that the weight mechanism could be constructed so that the weights could be removed from the apparatus and reintroduced as desired. Any conventional means of securing the plate-type weights to the cable could be employed.

Secured to the underside of the upper frame section 16 is a pulley block 45 which journals a pulley 47. In this case, it can be observed that the pulley 47 is located vertically above, or at least almost vertically above the weights 41. In this respect, the upper frame section 16 should be located at a height which is at least above the normal height of the user, as hereinafter described.

Located on the upper surface of the base housing 10 is another or second pulley block 48 which suitably journals a lower pulley 50. In this case, it can be observed that the lower pulley 50 which is often referred to as a second pulley, is located forwardly of the upper and first pulley 47. Moreover, the pulleys 47 and 50 are generally in the same vertical plane when viewed from the front of the apparatus.

Extending outwardly from the upper frame section 16 is a horizontally extending bracket 52 and which may be secured to the upper frame section 16 by any conventional means. Mounted on the underside of the horizontally extending bracket 52 is a third pulley block 54 for suitably journaling a third pulley 56. In this case, the third pulley 56 is located forwardly of the second pulley 50 and also preferably in vertical alignment with the second pulley 50 and the first pulley 47 when viewed from the front of the apparatus. In addition to the above, the third pulley 50 is preferably located at a height normally above the height of the user of the apparatus.

In one preferred embodiment of the invention, a fourth pulley block 58 may be suitably mounted on or associated with the carriage 26 in a manner to be hereinafter described, and which suitably journals a pulley, often referred to as a "carriage pulley" 60. The exact means of mounting the pulley block 58 and the pulley 60 is hereinafter described in more detail.

Secured to the carriage 26, and particularly, the forward plate 28 thereof, is in an adjustably positionable handle mechanism 62. The handle mechanism 62 is comprised of a vertically disposed height tube 64 which is capable of being shifted vertically within a rectangularly shaped collar 66, the latter being secured to the front plate 28, in the manner as illustrated in FIG. 4.

Moreover, the vertically shiftable height tube 64 is provided with vertically spaced apart apertures 70 which are designed to receive a removable locking pin 72. For this purpose, the collar 66 is similarly provided with an aperture with which any of the apertures 70 in the vertically shiftable tube 64 may be aligned.

Similarly vertically positionable on the shiftable tube 64 is a second collar 74 which carries an outwardly extending handle 76. Moreover, the collar 74 is provided with one or more apertures capable of being aligned with an aperture 70 in the tube 64 in order to receive a removable pin 78. In this way, it is possible to adjust the position of the tube 64 within the collar 66 and moreover, it is possible to adjust the relative height of the handle 76 by adjusting the position of the collar 74 on the tube 64. In this way, two adjustments are provided.

The handle 76 itself is preferably formed of a unitary member and is comprised of a first longitudinally extending bar 80 which merges into outwardly and forwardly struck parallel arms 82 and each of which are provided with longitudinally extending hand portions 84, much in the manner as illustrated in FIG. 1 of the drawings.

The versatility of the adjustable handle mechanism is unique in the apparatus of the present invention in that it enables a wide degree of handle positioning to be achieved in order to permit the user to accomplish a large number of exercises. Thus, by properly positioning the handle mechanism in a desired location, it permits the user to assume various positions, such as a prone position, a kneeling position or the like in order to perform desired weight lifting exercises.

The apparatus of the present invention also utilizes a cable 90, which may adopt the form of a wire cord or similar cable of the type normally used in weight lifting apparatus. In this case, the cable can be trained around any one or more, and preferably any two or more of the pulleys in the apparatus. In this case, the apparatus is uniquely designed such that the cable can be trained so as to enable a user to perform the desired weight lifting exercise apparatus. As indicated, the pulley block 58 is removably operatively attached to the carriage 26 and when not in use, can be easily removed therefrom. However, when the pulley block 58 and the pulley 60 carried thereby are used, the pulley lock 58 is removably attached to the upper end of the vertically shiftable tube 64. For this purpose, the pulley block 58 is provided with a depending bar 92 which is capable of fitting within the open upper end of the vertically shiftable tube 64. Moreover, the bar 92 is provided with an aperture 94 capable of being aligned with the aperture 70 in the tube 64 so as to receive the locking pin 72, as more fully illustrated in FIG. 4A. In this respect, the locking pin 72 is not needed with the sleeve 66 when the pulley block 58 is used. However, alternately, a different locking pin could be provided.

The carriage 26 may be fixed on the carriage support structure 20 for purposes of performing various exercises. Thus, the carriage 26 may be fixed intermediate the upper and lower ends of the support structure or at the upper or lower end thereof. Typically, the carriage is fixed to the support structure 20 at the lower end thereof when the pulley 60 is employed and in this case the pulley may be employed to take up what might otherwise be an excess of or slack in the cable.

Any conventional means could be employed to lock the carriage at its uppermost position or its lowermost position on the posts or any position therebetween, as may be desired to perform a certain exercise. Further, the positional locking of the carriage is effective so that users of different heights can use the apparatus to perform the same exercise by merely positioning the carriage at slightly different positions. One convenient form of locking means may adopt the form of an aperture in the carriage, such as in the plate 28. This aperture in the plate 28 would be capable of being aligned with an aperture 100 in a horizontally disposed bar 102 on the frame, when the carriage is in the lower position. A locking pin (not shown) could then be inserted in the aligned apertures to hold the carriage in such position. The horizontal bar 102 is also an effective means to limit the downward movement of the carriage. In like manner, if desired, locking bars could extend in apertures immediately above or below the rollers to restrain the carriage against an upward or downward movement.

The carriage is a highly effective means for permitting the handle mechanism to be shifted vertically up and down in a controlled path of movement. The carriage is uniquely designed so that it is easily constructed at a low cost and capable of being quickly assembled and disassembled at an on-site location, as is the remaining portion of the apparatus. Further, the carriage permits the handle mechanism to move easily, even with a substantial force imposed thereon, without any significant deflection thereof.

The four arrangements for the cable in FIGS. 5 to 8 are only illustrative of several cable arrangements which may be employed in the apparatus of the present invention. As indicated by enabling the cable to be trained around these various pulleys in a wide variety of configurations, a large number of weight lifting exercises may be performed.

Figure 5:
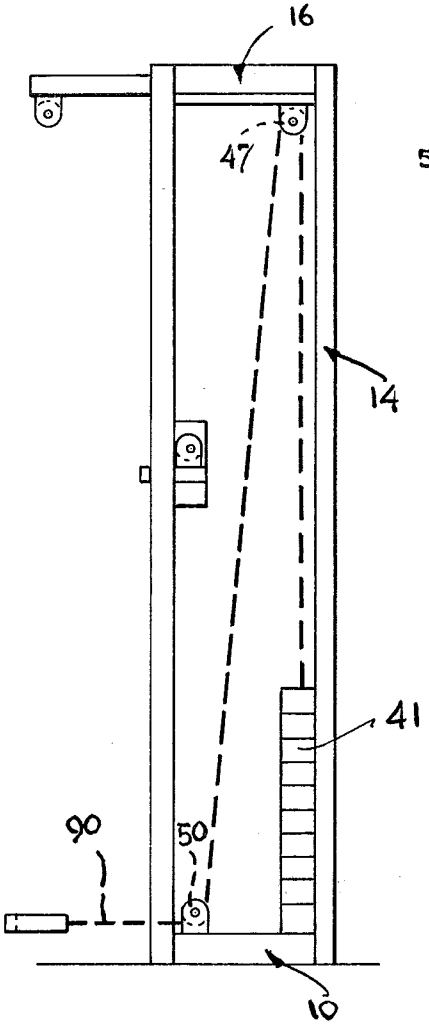

FIGS. 5 to 8 of the drawings show various arrangements for training the cable 90 about the various pulleys forming part of the apparatus of the invention. Moreover, it can also be observed that the handle mechanism can be completely removed in order to permit certain weight lifting exercises to be performed. FIG. 5, for example, illustrates an arrangement in which the cable 90 is trained around the upper pulley 47, and the lower pulley 50 and is provided with a hand grip mechanism such that the user may engage the hand grip mechanism with one or more hands in order to lift the selected amount of weights.

Figure 6:
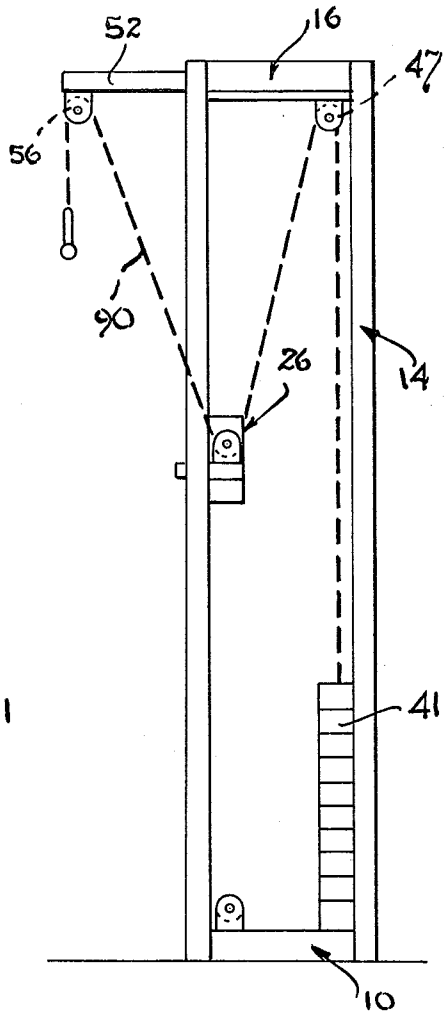

FIG. 6 illustrates another arrangement in which the cable 90 is trained around the upper pulley 47, the pulley 60 mounted on the carriage 26, and the upper pulley 56. In this was, a different form of weight lifting exercise can be performed such that the user effectively pulls down on a handle mechanism but which is not affixed to the carriage.

Figure 8:
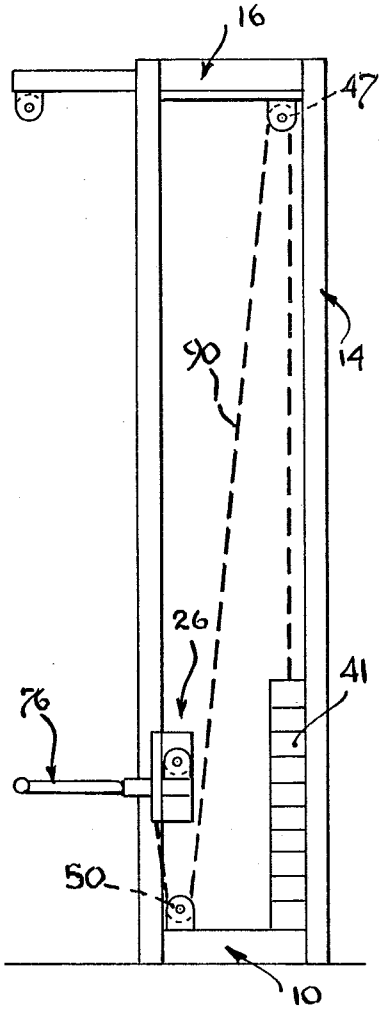

FIG. 7 illustrates a further arrangement in which a cable can be trained around the pulleys in the apparatus. In this case, the cable 90 is trained around the upper pulley 47, and directly around the upper pulley 56 and then around the carriage pulley 60. Finally, FIG. 8 illustrates another arrangement in which the cable 90 is trained around the upper pulley 47, the lower pulley 50 and connected to the carriage. This permits the use of the handle mechanism forming part of the apparatus.

Thus, there has been illustrated and described a unique and novel weight lifting exercising apparatus which includes a plurality of pulleys selectively located so that a cable can be trained about one or more of the pulleys in desired configurations to enable performance of a large number of exercises, and which therefore fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications which may become apparent to those skilled in the art after considering this specification and the accompanying drawings are deemed to be covered by the invention which is limited only by the following claims.

Having thus described my invention, what I desire to claim and secure by Letters Patent is:

1. A weight lifting exercising apparatus comprising:
(a) a base structure for disposition on a floor or other supporting surface,
(b) a generally upright frame associated with the base structure and extending upwardly therefrom,
(c) a vertically shiftable carriage associated with said frame and base structure and capable of being vertically movable against one or more weights,
(d) a first pulley operatively mounted on said frame generally above said carriage and at a height normally greater than the height of a user of the apparatus,
(e) a second pulley operatively mounted on said base structure at a height normally less than the height of a user and which is located substantially forwardly of the first pulley,
(f) a third pulley operatively mounted on said frame at a height normally above the height of the user and which is located forwardly of said second pulley and at a position so that it would be substantially immediately vertically above the user of the apparatus,
(g) a fourth pulley operatively mounted on said carriage and located forwardly of said second pulley and rearwardly of said third pulley
(h) cable means operatively engagable with said carriage and with one or more weights and capable of being selectively trained about any two or more of said first and second and third and fourth pulleys in a desired configuration selected to perform a certain weight lifting exercise, and
(i) handle means operatively connected to said carriage and operatively coupled to said cable means through said carriage, said handle means being engagable by a user to apply a force thereto to thereby attempt to shift the carriage against the one or more weights.

2. A weight lifting exercising apparatus comprising:
(a) a base structure for disposition on a floor or other supporting surface,
(b) a generally upright frame associated with the base structure and extending upwardly therefrom,
(c) a vertically shiftable carriage associated with said frame and base structure and capable of vertical movement against one or more weights,
(d) a first pulley operatively mounted on said frame and generally above said carriage and at a height normally greater than the height of a user of the apparatus,
(e) a second pulley operatively mounted on said base structure at a height normally less than the height of a user and which is located forwardly of the first pulley,
(f) an additional pulley operatively removably mountable on said carriage and which is located forwardly of said second pulley when mounted on said carriage,
(g) cable means operatively connected to said carriage and engagable with one or more weights and capable of being selectively trained about any two or more of said first and second pulleys and additional pulley in a desired configuration which is selected to perform a certain weight lifting exercise, said additional pulley being mounted on said carriage and said cable means being trained therearound when mounted on said carriage to perform certain exercises, and said additional pulley being removable from said carriage and said cable being trained around at least one of said first or second pulleys to perform certain other exercises, and
(h) handle means operatively connected to said carriage and causing movement of said cable means with said carriage, said handle means being engagable by a user to apply a force thereto to thereby attempt to shift the carriage against the one or more weights.

3. The weight lifting exercising apparatus of claim 2 further characterized in that said first and second pulleys and said additional pulley all generally lie within the same vertical plane.

4. The weight lifting exercising apparatus of claim 2 further characterized in that a third pulley is mounted on said frame, said additional pulley is located in a position forwardly of said second pulley and rearwardly of said third pulley on said frame.

5. The weight lifting exercising apparatus of claim 2 further characterized in that said frame means comprises a plurality of spaced apart upright beams secured to said base structure and a generally horizontally located top structure secured to upper portions of said upright beams.

6. The weight lifting exercising apparatus of claim 2, further characterized in that said handle means in adjustably positionable on said carriage.

7. A weight lifting exercising apparatus comprising:
(a) a base member capable of being disposed on a floor or other supporting surface,
(b) at least one generally upright post operatively secured to said base member and extending upwardly therefrom,
(c) a vertically shiftable carriage, movable along said at least one post and being supported thereby during its vertical shifting movement, said carriage being shiftable against a weight means associated with the apparatus,
(d) a plurality of spaced apart upright beams operatively connected to said base member and extending upwardly therefrom thereby forming a frame,
(e) an upper frame member secured to the upper portions of each of said upright beams and said upright post,
(f) a first pulley operatively mounted on said frame generally above said carriage and at a height normally greater than the height of a user of the apparatus,
(g) a second pulley operatively mounted on said base member at a height normally less than the height of a user and located forwardly of said first pulley,
(h) a third pulley operatively mounted on said upper frame member at a height normally above the height of the user and located forwardly of said second pulley, (i) cable means operatively connected to said carriage and to one or more weights and capable of being selectively trained about any two or more of said first and second and third pulleys in a desired configuration selected to perform a certain weight lifting exercise, and (j) handle means operatively associated with said carriage and operatively coupled to said cable means, said handle means being engagable by a user to apply a force thereto to thereby attempt to shift the carriage against the one or more weights.

8. The weight lifting exercising apparatus of claim 7 further characterized in that said first and second and third pulleys all generally lie within the same vertical plane.

9. The weight lifting exercising apparatus of claim 8 further characterized in that a fourth pulley is operatively mounted on said carriage and is adapted to have said cable means trained therearound.

10. The weight lifting exercising apparatus of claim 9 further characterized in that said first and second and third and fourth pulleys all generally lie within the same vertical plane.

11. The weight lifting exercising apparatus of claim 9 further characterized in that said fourth pulley is located in a position forwardly of said second pulley and rearwardly of said third pulley.

12. A weight lifting exercising apparatus comprising:

(a) a base member capable of being disposed on a floor or other supporting surface, (b) at least one generally upright post operatively secured to said base member and extending upwardly therefrom, (c) a vertically shiftable carriage movable along said at least one post and being supported thereby during its vertical shifting movement, said carriage being shiftable against a weight means associated with the apparatus, (d) a plurality of spaced apart upright beams operatively connected to said base member and extending upwardly therefrom thereby forming a frame, (e) an upper frame member secured to the upper portions of each said upright beams and said upright post, (f) a first pulley operatively mounted on said frame generally above said carriage and at a height normally greater than the height of a user of the apparatus, (g) a second pulley operatively mounted on said base member forwardly of said first pulley and at a height normally less than the height of a user, (h) a third pulley operatively mounted on said upper frame member forwardly of said second pulley and at a height normally above the height of the user, said first and second and third pulleys all generally lying in the same vertical plane, (i) a fourth pulley operatively mounted on said carriage, (j) cable means operatively engageable with said carriage and with one or more weights and capable of being selectively trained about any two or more of said first and second and third and fourth pulleys in a desired configuration selected to perform a certain weight lifting exercise, and (k) handle means operatively associated with said carriage and operatively coupled to said cable means through said carriage, said handle means being engagable by a user to apply a force thereto to thereby attempt to shift the carriage against the one or more weights.

13. The weight lifting exercising apparatus of claim 12 further characterized in that said first and second and third and fourth pulleys all generally lie within the same vertical plane.

14. The weight lifting exercising apparatus of claim 12 further characterized in that said fourth pulley is located in a position forwardly of said second pulley and rearwardly of said third pulley.

15. A weight lifting exercising apparatus comprising:

(a) base means, (b) a generally upright frame associated with the base means and extending upwardly therefrom, (c) a vertically shiftable carriage associated with said frame and base means and capable of being vertically movable against one or more weights, (d) a first pulley operatively mounted on said frame generally above said carriage and at a height normally greater than the height of a user of the apparatus, (e) a second pulley operatively mounted on said base means at a height normally less than the height of a user and which is located forwardly of the first pulley, (f) a third pulley operatively mounted on said frame at a height normally above the height of the user and which is located forwardly of said second pulley and at a position so that it would be immediately vertically above the use of the apparatus, (g) a fourth pulley provided for removable mounting to said carriage and capable of being optionally used depending on the type of exercise to be performed, (h) cable means operatively connected to said carriage and one or more weights, said cable means capable of being selectively trained about any two or more of said first and second and third pulleys in a desired configuration on one of said first, second and third pulleys and said fourth pulley as selected to perform a certain weight lifting exercise, and (i) handle means operatively associated with said carriage, said handle means being engagable by a user to apply a force thereto to thereby attempt to shift the carriage against the one or more weights.

16. The weight lifting exercising apparatus of claim 15 further characterized in that said first and second and third and fourth pulleys all generally lie within the same vertical plane.

17. The weight lifting exercising apparatus of claim 16 further characterized in that said fourth pulley is located in a position forwardly of said second pulley and rearwardly of said third pulley.

18. A weight lifting exercising apparatus comprising:

(a) a base structure for supporting disposition on a floor or other supporting surface, (b) a generally upright frame removably but rididly mounted on said base structure and extending upwardly therefrom, said upright frame being comprised of at least four upright frame members, (c) first mechanical fastening means for securing said frame to said base structure in such manner that said first mechanical fastening means can be released for releasing said frame from said base structure, (d) an upper frame structure secured to the upper end of said upright frame, (e) second mechanical fastening means for securing said frame to said upper frame structure in such manner that said second mechanical fastening means can be released for releasing said frame from said upper frame structure, (f) a pair of spaced apart interior posts extending between and secured to said base structure and said upper frame structure, (g) third mechanical fastening means for securing said posts to said base structure and said upper frame structure in such manner that said third mechanical fastening means can be released from base structure and upper frame structure for disassembling said posts from said upper frame structure and base structure, (h) a carriage vertically shiftable on said posts and having roller means adapted to ride on such posts, (i) weight retaining means operatively carried by said carriage for receiving bar-bell type weights, (j) cable means operatively engageable with said carriage and with one or more weights and capable of being selectively trained about a pulley in a desired configuration selected to perform certain weight lifting excercises, and (k) handle means operatively associated with said carriage and operatively coupled to said cable means through said carriage, said handle means being engageable by a user to apply a force thereto to thereby attempt to shift the carriage against the one or more weights.

19. The weight lifting exercising apparatus of claim 18 further characterized in that the pulley means comprises:

(1) a first pulley operatively mounted on said upper frame structure generally above said carriage and at a height normally greater than the height of a user of the apparatus, (2) a second pulley operatively mounted on said base structure at a height normally less than the height of a user and which is located forwardly of the first pulley, and (3) a third pulley operatively mounted on said upper frame structure at a height normally above the height of the user and which is located forwardly of said second pulley and at a position so that it would be immediately vertically above the use of the apparatus, said cable means being operatively engageable with said carriage and with one or more weights and capable of being selectively trained about any two or more of said first and second and third pulleys in a desire configuration selected to perform a certain weight lifting exercise.

20. The weight lifting exercising apparatus of claim 19 further characterized in that said first and second and third pulleys all generally lie within the same vertical plane.

21. The weight lifting exercising apparatus of claim 19 further characterized in that a fourth pulley is operatively mounted on said carriage and is adapted to have said cable means trained therearound.

22. The weight lifting exercising apparatus of claim 21 further characterized in that said fourth pulley is removably attached to said carriage, and optionally used to perform certain exercises.

23. A weight lifting exercising apparatus comprising:

(a) a base structure capable of being disposed on a floor or other supporting surface, (b) an upper frame structure disposed above said base structure, (c) a plurality of spaced apart upright beams operatively connected to said base member and extending upwardly therefrom to said upper frame structure thereby forming a main frame, (d) a pair of spaced apart generally upright posts operatively secured to said base member and extending upwardly therefrom and secured to said upper frame structure, (e) a vertically shiftable carriage movable along said posts and being supported thereby during its vertical shifting movement, said carriage being shiftable against a weight means associated with the apparatus, (f) a plurality of first rollers on the front of said carriage bearing against the forwardly presented surfaces of said posts, (g) a plurality of second rollers on the rear of said carriage bearing against the rearwardly presented surfaces of said posts, (h) a plurality of third rollers interiorly of said carriage and bearing against the interiorly presented side surfaces of said posts, (i) pulley means operatively mounted on said frame, (j) cable means operatively engageable with said carriage and with one or more weights and capable of being selectively trained about said pulley means in a desired configuration selected to perform a certain weight lifting exercise, and (k) handle means operatively associated with said carriage, said handle means being engagable by a user to apply a force thereto to thereby attempt to shift the carriage against the one or more weights.

24. The weight lifting exercising apparatus of claim 23 further characterized in that said pulley means comprises:

(1) a first pulley operatively mounted on said frame generally above said carriage and at a height normally greater than the height of a user of the apparatus, (2) a second pulley operatively mounted on said frame at a height normally less than the height of a user, and (3) a third pulley operatively mounted on said frame at a height normally above the height of the user,

25. The weight lifting exercising apparatus of claim 24 further characterized in that said second pulley is located forwardly of said first pulley and said third pulley is located forwardly of said second pulley.

26. The weight lifting exercising apparatus of claim 25 further characterized in that a fourth pulley is operatively mounted on said carriage and is adapted to have said cable means trained therearound.

27. The weight lifting exercising apparatus of claim 26 further characterized in that said first and second and third and fourth pulleys all generally lie within the same vertical plane, and that said fourth pulley is located in a position forwardly of said second pulley and rearwardly of said third pulley.

28. A weight lifting exercising apparatus comprising:

(a) a base structure for disposition on a floor or other supporting surface, (b) a generally upright frame comprised of a plurality of spaced apart upright beams secured to said base structure and extending upwardly therefrom, (c) a generally horizontally located top structure secured to the upper portions of said upright beams, (d) a vertically shiftable carriage associated with said frame and base structure and capable of being vertically movable against one or more weights, (e) a first pulley operatively mounted on said frame generally above said carriage and at a height normally greater than the height of a user of the apparatus, (f) a second pulley operatively mounted on said base structure at a height normally less than the height of a user and which is located substantially forwardly of the first pulley, (g) a third pulley operatively mounted on said frame at a height normally above the height of the user and which is located forwardly of said second pulley and in a position so that it would be substantially immediately vertically above the user of the apparatus, (h) cable means operatively engagable with said carriage and with one or more weights and capable of being selectively trained about any two or more of said first and second and third pulleys in a desired configuration selected to perform a certain weight lifting exercise, and (i) handle means operatively connected to said carriage and operatively coupled to said cable means through said carriage, said handle means being engagable by a user to apply a force thereto to thereby attempt to shift the carriage against the one or more weights.

29. The weight lifting exercising apparatus of claim 28 further characterized in that said first and second and third pulleys all generally lie within the same vertical plane.

30. The weight lifting exercising apparatus of claim 28 further characterized in that a fourth pulley is operatively mounted on said carriage and is adapted to have said cable means trained therearound.

31. The weight lifting exercising apparatus of claim 30 further characterized in that said first and second and third and fourth pulleys all generally lie within the same vertical plane.

32. The weight lifting exercising apparatus of claim 30 further characterized in that said fourth pulley is removably attached to said carriage.

* * * * *